United States Patent [19]

Neufeld

[11] 4,014,426

[45] Mar. 29, 1977

[54] PAPER SUPPORT ROLL MECHANISM FOR USE IN A TELETYPEWRITER OR OTHER SUCH PRINTING DEVICE

[75] Inventor: Manfred Neufeld, Baierbrunn, Germany

[73] Assignee: Siemens Aktiengesellschaft, Berlin & Munich, Germany

[22] Filed: Mar. 4, 1976

[21] Appl. No.: 663,741

[30] Foreign Application Priority Data

Mar. 20, 1975 Germany ..... 2512274

[52] U.S. Cl. ..... 197/133 R; 197/133 A; 242/68.4; 242/68.3

[51] Int. Cl.[2] ..... B41J 15/00

[58] Field of Search ..... 197/133 R, 133 A, 134; 242/68, 68.3, 68.4, 68.5, 68.6

[56] References Cited

UNITED STATES PATENTS

| | | | |
|---|---|---|---|
| 525,916 | 9/1894 | Merriman | 242/68.4 |
| 891,073 | 6/1908 | Hutchinson | 197/133 A |
| 1,491,609 | 4/1924 | Kenworthy et al. | 242/68.4 |
| 1,803,286 | 4/1931 | Thatcher | 242/68.4 X |
| 2,360,591 | 10/1944 | Sim | 197/133 R |
| 2,483,528 | 10/1949 | Christoff | 242/68.3 |
| 2,555,728 | 6/1951 | Bradt | 197/133 R |
| 2,640,658 | 6/1953 | Swanson | 242/68.3 |
| 2,983,531 | 5/1961 | Moro | 242/68.3 X |
| 3,281,090 | 10/1966 | Baranowski, Jr. | 242/68.4 X |
| 3,482,607 | 12/1969 | Villani et al. | 242/68.4 X |

FOREIGN PATENTS OR APPLICATIONS

| | | | |
|---|---|---|---|
| 898,150 | 9/1943 | France | 242/68.4 |
| 384,651 | 11/1923 | Germany | 242/68.4 |

*Primary Examiner*—E. H. Eickholt
*Attorney, Agent, or Firm*—Hill, Gross, Simpson, Van Santen, Steadman, Chiara & Simpson

[57] ABSTRACT

A paper support roll mechanism for use within a teletypewriter is formed with a paper support roll supported on a shaft which is in turn held by bearing support brackets located on each side of the roller. The support brackets also hold a cutting blade and engaging spring such that paper utilized by the teletypewriter is held in close contact with the support roller. The device may be provided with a hand manipulated handle allowing advancement of the paper by a user. The mechanism is so designed that no screws, bolts or other such securing devices are required for assembly, thus allowing the user to quickly install or remove the supported mechanism as required.

3 Claims, 1 Drawing Figure

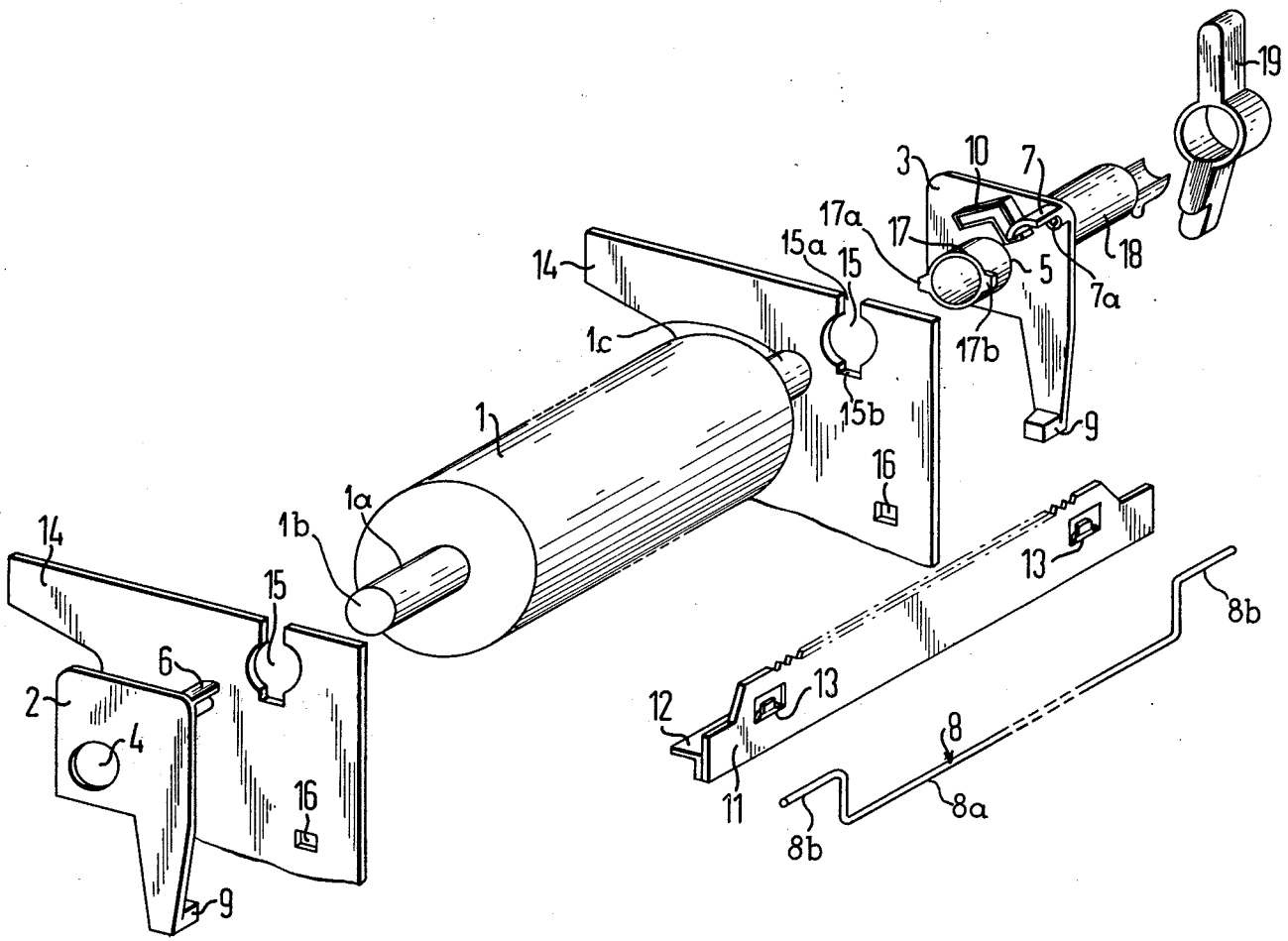
19
18
7a
9
7
5
10
17b
3
17
17a
15
15a
15b
16
13
8b
8
8a
11
12
1c
14
1
1a
1b
2
4
6

PAPER SUPPORT ROLL MECHANISM FOR USE IN A TELETYPEWRITER OR OTHER SUCH PRINTING DEVICE

BACKGROUND OF INVENTION

1. Field of Invention

This invention relates to a paper support roll used in conjunction with a cutting blade where paper in a teletypewriter is fed between a roller and a blade wherein a user may remove an end portion of the paper which may contain printed material. This device is particularly applicable to use within a teletypewriter or other such printing devices.

2. Description of Prior Art

In teletypewriters or other such printing devices paper from a roll is fed through a printing section and then between a roll and an attached cutting blade whereby a user can sever the printed portion of the paper.

The mounting of the roll and the blade heretofore required separate mounting means whereby these means, the roll and blade were secured to the printer by the use of screws or other such fastening devices. The assembly was fairly complicated and therefore time consuming since each part had its own mounting means. Because of this extensive mounting preparation, replacement or repair of the support roll and pressure blade proved to be difficult and time consuming.

SUMMARY OF INVENTION

A roll having a suitable shaft therethrough is mounted between two support members having openings therein for the shaft. The shaft in turn is held by a bearing support bracket mounted to a outer side of each support member and secured to the support member by use of a friction fit, between engaging portions of the support bracket and the support member. The bracket can also be secured to the support member by providing a key-shaped aperture in the member wherein is disposed a like key-shaped sleeve carried by the bracket. By rotating the bracket 90° after insertion, a bayonet type fit between the support member and the locking sleeve is formed insuring that the bearing bracket remains in its intended location.

Additionally, the bearing bracket contains means to support ends of a cutting blade. The means are so located that the blade is positioned adjacent to the outer surface of the roll and held there under pressure by a wire spring also supported from the bearing brackets. The spring engages the backside of the blade to apply pressure against the blade insuring that the paper fed between such remains taut when the user severs a portion of the paper.

At one end of the shaft, an optional handle can be provided to allow a user to advance the paper from the paper roll in the teletypwriter.

A first advantage of this arrangement is its simplicity since the complete mechanism requires only six components distinctive from the teletypewriter itself.

A second advantage is that no screws or other fastening devices are required to assemble the roll and blade within the teletypewriter. Initial installation can be readily made as well as the roll and blade quickly disassembled when repair or other replacement is required.

BRIEF DESCRIPTION OF THE DRAWINGS

FIG. 1 is an explosion view in perspective of the roll support mechanism.

DESCRIPTION OF THE PREFERRED EMBODIMENT

An explosion view of the support mechanism as shown in FIG. 1 depicts a cylindrically-shaped roll 1 made of a suitable material. Through the roll 1 is an axially disposed shaft 1*a* having end portions 1*b* and 1*c* which extend outwardly on each side of the roll 1. A teletypewriter or other such printing device is provided with a pair of vertical support members 14 as an integral part of the teletypewriter or other such device. This pair of support members is so located to provide sufficient space allowing the roll 1 to be free of any side interference. In the support member 14 is a first aperture 15 in each of the support members 14 allowing the end portions 1*b* and 1*c* of the shaft 1*a* to extend therethrough. The shaft 1*a* is supported on each outer side of the support member 14 by a bearing support bracket 2 and 3 respectively. These brackets 2 and 3 have an L-shaped configuration. By the use of this configuration, two such brackets may be blanked from a larger rectangular piece so as to minimize material waste.

Each bearing support bracket 2 and 3 has an inwardly protruding wedge-shaped nipple 9 which is designed to be secured in a like dimensioned rectangular hole 16 in the respective support members 14 upon assembly. Each of the bearing support members has a circular shaft support opening in which the end portions 1*b* and 1*c* of the shaft 1*a* is disposed and supported therein.

To insure that the bearing support bracket 2 or 3 does not become disengaged from support member 14 after assembly, the bracket 2 or 3 can be provided with a locking sleeve 17 which engages with the aperture 15 in the support member 14.

The sleeve can be provided with two outward protrusions 17*a* and 17*b*. When such a sleeve is to be used, the aperture 15 is provided with a like dimensioned and correspondingly positioned rectangular openings 15*a* and 15*b* adjoining aperture 15. The sleeve 17 is so carried by a bearing support bracket that to assemble the bracket 2 or 3 to support member 14, the protrusions 17*a* and 17*b* are first aligned with openings 15*a* and 15*b*. The sleeve 17 is then inserted in the aperture 17 and rotated 90° to form a bayonet type locking arrangement.

The bearing support brackets 2 and 3 are provided with a blade mounting bracket 10 in which a cutting blade 11 is loosely supported. The blade 11 is reinforced longitudinally by a reinforcing angle 12. The blade 11 is also provided with two spring support tabs 13, one at each end of the blade 11. The purpose of these tabs 13 is to secure a middle portion 8*a* if a wire spring 8 insuring that the spring 8 remains in contact with the blade 11.

Each bearing support bracket 2 and 3 has a spring support opening 7*a* into which a respective end portion 8*b* of the spring 8 is disposed. Additionally, adjacent to the hole 7*a* is a spring biasing bracket 7 so positioned that upon assembly, i.e. the end portions of the blade 11 are inserted in brackets 10 and the middle portion 8*a* of the spring 8 is affixed to the blade 11 by the tabs 13 and its end portion 8*b* are inserted in openings 7*a*, the spring 8 is twisted forcing the blade 11 against the roll 1.

It is understood that a source of paper normally supplied in the form of a roll is first printed and then fed between the blade 11 and the roll 1.

As an accessory, the mechanism can be provided with a mounting sleeve 18 which may be fastened by a suitable means to one end portion of the shaft 1*a* and a suitable handle 19 attached thereto allowing a user to advance the paper over the roll manually.

While various modifications may be suggested by those versed in the art, it should be appreciated that I wish to embody within the scope of the patent warranted herein all such modifications as reasonably and properly come within the scope of my contribution to the art.

I claim as my invention:

1. A paper support roll mechanism for use in and carried by a printing device such as a teletypewriter comprising:

a. a first and second vertical support member being separated to form a space therebetween, said members being carried by said printing device and having a respective first aperture respectively prepared to receive a locking sleeve in one of said apertures and a shaft in the other of said apertures, and a second respective aperture having a rectangular configuration and prepared to receive a bearing support bracket nipple, b. a roll means comprising a solid elongated cylindrically-shaped roll and a shaft axially disposed and aligned with the longitudinal axis of said roll, and having end portions extending outwardly from said roll, said roll positioned between said support member with said shaft end portions being disposed in said first aperture respectively, c. a first and a second bearing support bracket respectively comprising a flat inverted L-shaped body having an upper horizontal leg portion and a vertical leg portion connecting thereto, an elastic wedge-shaped nipple carried by said vertical leg portion and extending inwardly, said nipple prepared for disposition in said second aperture in said support member with a friction fit, a circular bearing hole through said horizontal leg portion prepared to support the end portion of said shaft, an elongated cylindrically shaped sleeve carried by and protruding inwardly from said first bracket, said sleeve being axially aligned with said bearing hole in said bracket, a second circular aperture through said body prepared to receive a wire spring, and a spring biasing bracket carried by said body adjacent to said spring aperture to engage said spring, said first bracket joined to said first support member by the insertion of said sleeve into said first aperture in said support member and said nipple into said second aperture, to form a friction joint, and said second bracket joined to said second support member by the insertion of said nipple in said second aperture, said one end portion of said shaft disposed in said sleeve of said first bracket and said other end of said shaft inserted through said first aperture of said second support member and disposed in said bearing hole in said second bracket, d. a cutting blade to maintain said paper in close contact with said roll comprising a flat elongated body having an upper horizontal cutting edge for cutting said paper, two offset spring retention tabs located adjacent to respective ends of said body, and an elongated reinforcing angle carried by said blade, said end portions of said blade being disposed in said blade retention bracket of said bearing support bracket respectively with a loose fit, e. a pan-shaped blade spring comprising a wire formed having end portions aligned parallel to a middle portion, and intermediate portions joining with said end portion and middle portion at a right angle, said middle portion disposed in said offset tabs of said blade and said end portions disposed in said second aperture in said bearing support bracket respectively with a rotational fit, and said intermediate portions engaging said spring engagement brackets respectively, wherein said blade is held against said roll by said spring to form a pressure joint between said roll and said blade.

2. A paper roll support mechanism as defined by claim 1 and further characterized by, a roll advancement means having a body portion engaging one end portion of said shaft and a handle portion attached thereto, wherein said roll can be rotated by manipulation of said handle.

3. A paper roll support mechanism as defined by claim 1 and further characterized by, said first aperture in said first support member being key-shaped having an inner circular portion and an upper and lower rectangular portion aligned with the vertical axis of said aperture, said locking sleeve of said bearing support bracket having a first and second rectangular shaped protrusion extending outwardly and aligned with the horizontal axis one on each side of said sleeve, said protrusion prepared for disposition with said key-shaped aperture of said support member upon said protrusions being aligned with said rectangular portion of said aperture, wherein said sleeve is disposed in said aperture and said bearing support bracket is rotated 90° to form a bayonet fit between said sleeve and said aperture.

* * * * *